US005496156A

United States Patent [19]

Harper et al.

[11] Patent Number: 5,496,156

[45] Date of Patent: Mar. 5, 1996

[54] SUCTION MUFFLER

[75] Inventors: Harold M. Harper, Brooklyn; Raymond J. Schmitz, III; Tara C. Kandpal, both of Tecumseh, all of Mich.

[73] Assignee: Tecumseh Products Company, Tecumseh, Mich.

[21] Appl. No.: 525,860

[22] Filed: Sep. 5, 1995

Related U.S. Application Data

[63] Continuation of Ser. No. 310,418, Sep. 22, 1994, abandoned.

[51] Int. Cl.[6] ..... F04B 39/00

[52] U.S. Cl. ..... 417/312; 181/403

[58] Field of Search ..... 417/312, 902; 181/403, 246, 264

[56] References Cited

U.S. PATENT DOCUMENTS

| | | | |
|---|---|---|---|
| 3,279,683 | 10/1966 | Kleinlein | 417/902 |
| 4,313,715 | 2/1982 | Richardson, Jr. | 417/902 |
| 4,370,104 | 1/1983 | Nelson et al. | 417/902 |
| 4,401,418 | 8/1983 | Fritchman | 417/312 |
| 4,412,791 | 11/1983 | Lal | 417/902 |
| 4,534,861 | 8/1985 | Wedemeyer et al. | 417/312 |
| 4,582,468 | 4/1986 | Bar | 417/312 |
| 4,784,581 | 11/1988 | Fritchman | 417/312 |
| 4,784,583 | 11/1988 | Bar | 417/312 |
| 4,960,368 | 10/1990 | Lilie | 417/312 |
| 4,990,067 | 2/1991 | Sasano et al. | 417/312 |
| 5,101,931 | 4/1992 | Blass et al. | 181/403 |
| 5,160,247 | 11/1992 | Kandpal | 417/415 |
| 5,207,564 | 5/1993 | Fritchman | 417/312 |
| 5,270,811 | 6/1993 | Harper et al. | 417/312 |
| 5,288,212 | 2/1994 | Lee | 417/902 |
| 5,304,044 | 4/1994 | Wada et al. | 417/312 |
| 5,344,289 | 9/1994 | Fasce | 417/312 |

FOREIGN PATENT DOCUMENTS

| | | | |
|---|---|---|---|
| 0195486 | 9/1986 | European Pat. Off. | 417/312 |

*Primary Examiner*—Peter Korytnyk
*Attorney, Agent, or Firm*—Baker & Daniels

[57] ABSTRACT

A hermetic compressor including a suction muffler disposed opposite the suction inlet tube. A funnelled or countersunk inlet port on the muffler permits semi-direct refrigerant flow into the muffler, creating enhanced cooling of the motor and higher compressor efficiency. Baffle walls disposed parallel and on opposite sides of an internal standpipe within the suction muffler create an increased resonator effect with optimum refrigerant throughput.

19 Claims, 2 Drawing Sheets

SUCTION MUFFLER

This is a continuation of application Ser. No. 08/310,418, filed Sep. 22, 1994, now abandoned.

BACKGROUND OF THE INVENTION

The present invention relates generally to a hermetic compressor and more particularly to small refrigeration compressors having suction mufflers utilized in household appliances. An area of interest in the compressor art is how to construct a more efficient and quieter compressor. The efficiency of a compressor is expressed as an energy efficiency ratio (EER) which is measured by dividing the BTU per hour output of the compressor by the power consumption under standard running conditions. The higher the EER the greater the efficiency.

One area that has received attention is that of heat transfer within the hermetic compressor. Some prior art compressors have suction mufflers that easily transport heat from the compressor unit to the flowing refrigerant therein, thereby reducing the efficiency of the compression cycle. Additional problems with prior art suction mufflers are inadequate flow characteristic and a noise response level that is too large for use in household appliances.

SUMMARY OF THE INVENTION

According to the present invention, it is found that noise and heat transfer are reduced by the use of a thermoplastic suction muffler having a unique baffling arrangement attached to the cylinder head of the compressor.

In the preferred embodiment of the invention, a compressor having a motor compressor unit disposed within a hermetic housing include a suction muffler formed of thermoplastic. A wall of the suction muffler faces the suction inlet tube and includes a funneled or countersunk inlet port to permit semi-direct flow of refrigerant fluid into the muffler.

In one form of the invention, an internal suction standpipe is disposed within the muffler housing having an end at a particular spaced distance from the inlet port while at the other end attached into the compressor. A baffle wall is located within the housing extending between and parallel with the suction standpipe and a side wall of the muffler housing to form a subchamber that acts as a resonator.

In another embodiment of the invention, two baffles are utilized extending from opposites sides of the muffler housing opposite the standpipe to create a substantially W-shaped volume to form a resonance cavity.

A particular advantage of the compressor of the present invention is that direct heat transfer from the compressor unit to incoming refrigerant fluid is minimized by constructing the muffler housing from an insulative thermoplastic.

Another advantage of the compressor of the present invention is that efficiency is improved by the countersunk inlet port of the muffler and its proximity to the compressor housing suction inlet tube by creating a semi-direct suction intake effect. Motor cooling is enhanced with the semi-direct refrigerant flow of the present invention.

Yet another advantage of the compressor of the present invention is that efficiency is further improved by the small distance between the countersunk inlet port and suction standpipe. Throttling of the incoming refrigerant fluid flow due to the standpipe and baffle is minimized.

A further advantage of the compressor of the present invention is that a maximum flow of refrigerant fluid to the compressor suction valve is created by the suction standpipe extending into the suction cavity of the cylinder head close to the suction valve.

Yet a further advantage of the compressor of the present invention is that the relatively large muffler volume in a semi-kidney shaped housing having internal baffles provides improved flow characteristics, reduced sound transmittance, and increased muffler stiffness.

The invention, in one form thereof, comprises a hermetic compressor having a housing in which a motor compressor unit is disposed for compressing fluid. The housing has a suction inlet tube emptying refrigerant into the interior of the housing. A suction muffler formed from a rounded plastic box-shaped muffler housing includes a front wall, back wall and side walls connecting therebetween, the front wall having a counter sunk inlet port. The suction inlet tube is spaced apart from the inlet port so refrigerant fluid impacts against the back wall of the muffler whereby semi-direct fluid flow into the inlet port is created, thereby improving the motor cooling. A suction standpipe is disposed within the muffler housing extending from the compressor unit to a location a spaced distance away from the inlet port. This spaced distance is dimensioned to provide maximum flow of refrigerant fluid through the standpipe after the fluid from said suction tube impacts the back wall of the muffler housing. A baffle wall is disposed within the muffler housing extending from the front wall to the back wall, the baffle wall located between the standpipe and a side wall of the housing to form a subcavity that acts as a resonator.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
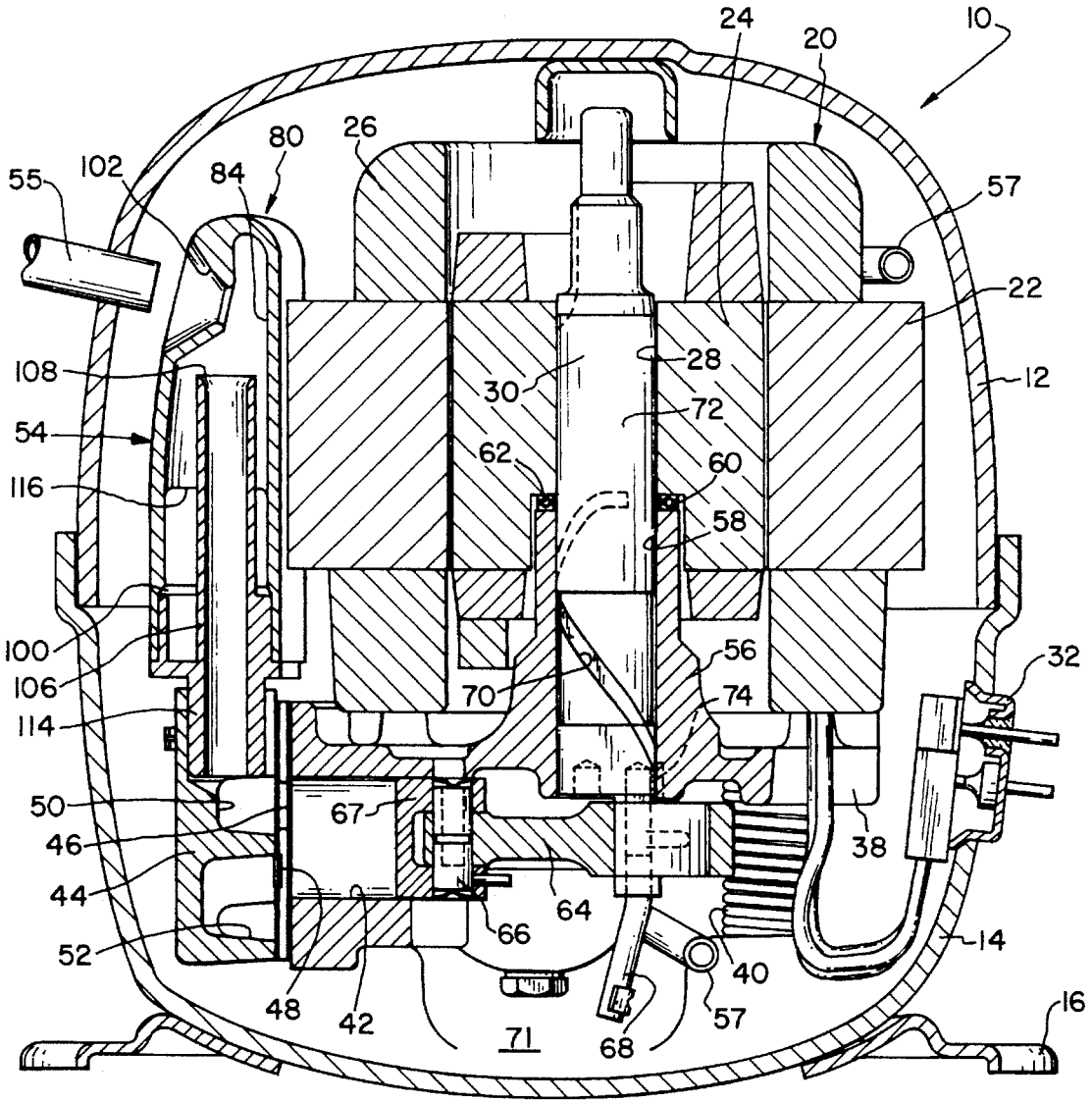
FIG. 1 is a longitudinal sectional view of a compressor of the type to which the present invention pertains.
Figure 4:
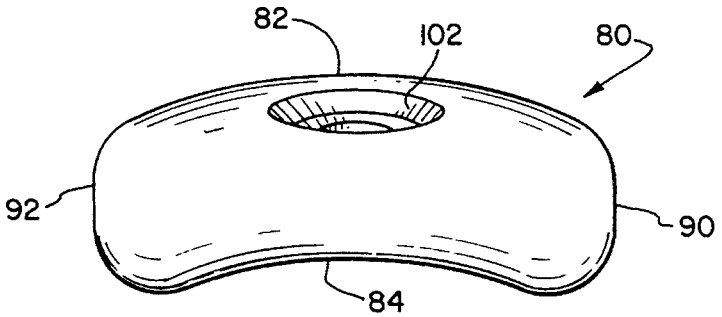
FIG. 4 is an enlarged top view of one form the suction muffler of the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown a compressor having a housing generally designated as 10. The housing has a top portion 12 and a lower portion 14 that are hermetically secured together as by welding or brazing. A flange 16 is welded to the bottom of housing 10 for mounting the compressor.

Located inside the hermetically sealed housing 10 is a motor generally designated at 20 having a stator 22 and rotor 24. The stator 22 is provided with windings 26. Stator 22 is secured to the support frame or cylinder block 38 by means of screws. The rotor 24 has a central aperture 28 provided therein into which is secured crankshaft 30 by an interference fit. A hermetic terminal 32 is provided on bottom portion 14 of the compressor for connecting motor 20 to a source of electrical power.

Within housing 10 is mounted a support frame or cylinder block 38 resiliently suspended within housing 10 by suitable spring mounts such as a compression spring 40 connected to cylinder block 38 and bottom portion 14 of compressor 10. Although only one spring is shown, it is to be understood that a number of springs are provided at proper positions to support cylinder block 38 within housing 10.

Cylinder block 38 has a horizontally extending cylinder bore 42 which is sealed off at the end adjacent to housing 10 by cylinder head 44 including suction valve 46, discharge valve 48, suction plenum 50 and discharge plenum 52. Discharge plenum 52 is in communication with a discharge tube 57 that leads out of housing 10. From the center of cylinder block 38 extending upwardly is a bearing hub 56 having an end face 60 defining a vertical bearing bore 58.

Crankshaft 30 is journalled for rotation within vertical bearing bore 58. A bearing 62 rides upon endface 60 of bearing hub 56. A connecting rod 64 is attached to the end of crankshaft 30 that extends through bearing bore 58 and additionally attached to piston wrist pin 66 that fits within cylinder bore 42. Connecting rod 64 causes piston 67 to reciprocate within cylinder bore 42 as crankshaft 30 rotates.

The reciprocating compressor described herein additionally provides a lubrication system for lubricating the components of the compressor including the crankshaft 30 and bearing 62. An oil pickup tube 68 is disposed within crankshaft 30 and is in communication with spiral groove 70 extending around the outer surface 72 of crankshaft 30. Oil pickup tube 68 is partially immersed in an oil sump 71. Spiral groove 70 is in communication with a radial oil passage 74 (see FIG. 1). Radial oil passage 74 allows oil to travel to groove 70 and through groove 70 to bearing 62. Connected to cylinder head 44 is a suction muffler 80 of the present invention. A suction inlet tube 55 permits refrigerant to enter compressor from a refrigerant system (not shown).

Figure 2:
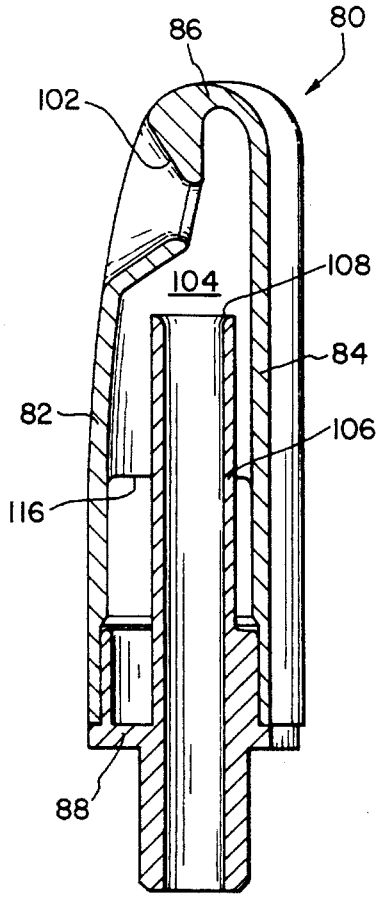
FIG. 2 is an enlarged side sectional view of the suction muffler of the present invention.
Figure 3:
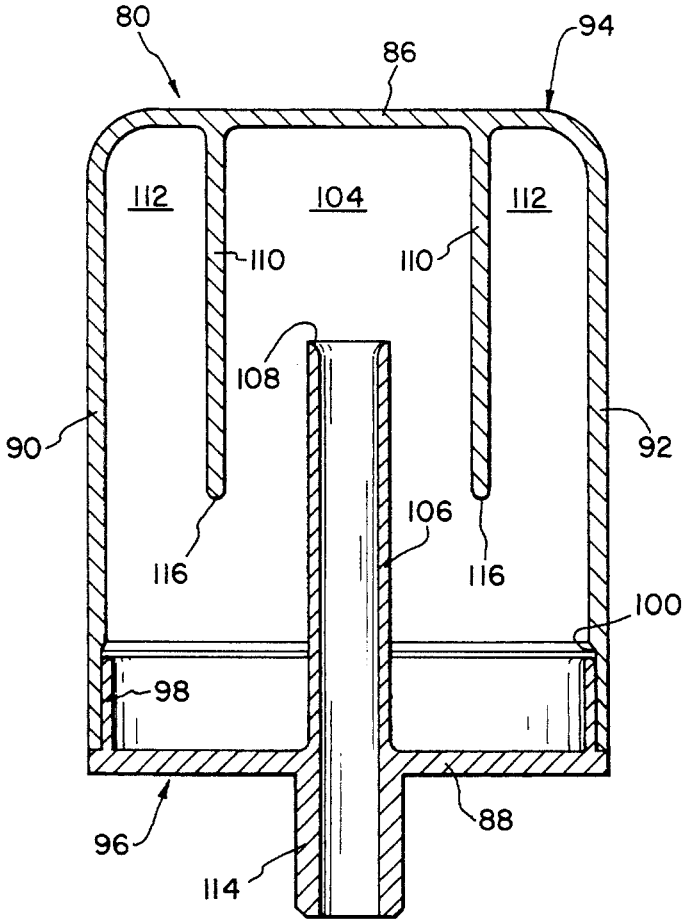
FIG. 3 is an enlarged front sectional view of the suction muffler of the present invention.

Suction muffler 80 in a preferred embodiment is a curved thermoplastic housing. As shown in FIGS. 2 and 3 suction muffler 80 includes a front wall 82 and a back wall 84 connected there between by a top wall 86 and bottom wall 88. Suction muffler 80, additionally includes two side walls 90 and 92 forming left and right side walls, respectively, as viewed in FIG. 3. Relative to front and back walls 82 and 84, top and bottom walls 86 and 88 may also be collectively considered side walls. The described above walls together form a muffler housing for suction muffler 80.

Preferably, muffler 80 is constructed from two members, a top member 94 and bottom member 96, both constructed of a thermoplastic such as Valox 420 commercially available from General Electric Plastics of Fairfield, Conn. Alternatively, other types of thermoplastics may be utilized. Preferably, the wall thickness is maintained between approximately 0.084 to 0.104 inches to provide sufficient strength with the internal compressor and environment wall minimizing the amount and weight of muffler 80. Any material utilized must insulate the suction refrigerant flow from direct heat transmission from cylinder head 44.

Muffler 80 takes the shape of a semi-kidney shaped housing. This particular shape increases the total strength of muffler 80 while minimizing gas flow turbulence therethrough. The curving nature, in three dimensions, of muffler 80 maximizes the internal volume thereby leading to an overall sound muffling improvement.

In a preferred form of the invention, bottom member 96 which includes bottom wall 88 has an upstanding engagement wall 98 over which top member 94 interfits. Each of the walls of top member 94, i.e., front and back, left and right side walls 82, 84, 90 and 92 respectfully include an internal bevelled edge 100, which engages upstanding engaging wall 98, when top member 94 is interfit with bottom member 96. Top and bottom members 94 and 96 may be permanently attached together by means of gluing, welding or another attachment method.

Front wall 82 includes a funnel-like or countersunk inlet port 102 to permit refrigerant fluid to enter into the interior 104 of suction muffler 80. Inlet port 102 is oriented relatively close, but in a spaced apart fashion from suction tube 55 to allow a semi-direct suction intake to be created. Semi-direct suction intake permits a majority of the incoming refrigerant fluid at suction pressure to enter muffler 80, while allowing a small portion to mix with the refrigerant content of compressor housing halves 12 and 14.

A suction muffler standpipe 106 is disposed within suction muffler 80 to conduct refrigerant fluid from interior 104 to suction plenum 50 and suction valve 46. As shown in FIG. 3, in the preferred embodiment standpipe 106 may be integrally or monolithically formed with bottom member 96, extending away from bottom wall 88. Standpipe 106 includes a rim 108 interior to suction muffler 80 forming the opening through which refrigerant fluid flows during operation. Rim 108 is located a spaced distance away from inlet port 102, this spaced distance is dimensioned to provide maximum flow of fluid through standpipe 106 after the refrigerant fluid has entered inlet port 102 and impacted back wall 84.

Baffle walls 110 as shown in FIG. 3 and utilized to create the muffling effect, extend between front wall 82 and back wall 84, and from top wall 86. Baffle walls 110 are located between and parallel with standpipe 106 and side walls 90 and 92. In this form of the invention the interior volume 104 of suction muffler 80 takes on a substantially W shaped configuration with the creation of lateral subcavities 112 divided from interior 104. Subcavities 112 act as resonators for sound and pressure pulses created by suction valve 46 during compressor operation. The exterior portion of standpipe 106 includes an enlarged end 114 that extends into suction plenum 50 in close proximately to the suction valve 46 to provide maximum flow of refrigerant fluid to cylinder 42.

Each baffle wall 110 includes an end 116 that essentially separates each subcavity 112 from the main interior 104 of suction muffler 80. End edges 116 overlap rim 108 of standpipe 106 as shown in FIG. 2, thereby forcing fluid within subcavity 112 to change direction prior to entering standpipe 106. This necessary changing of direction of the fluid between subcavities 112 and the interior of standpipe 106 creates the increased resonance and muffling effect for muffler 80, while the single turn insures a maximum flow of refrigerant gas through inlet port 102 to suction plenum 50.

During compressor operation, refrigerant fluid at suction pressure will enter compressor 10 through suction tube 55 and flow in a semi-direct fashion into suction muffler 80 through funneled or countersunk inlet port 102. By forming inlet port 102 and countersunk or funnel fashion the majority, but not all incoming refrigerant fluid will enter suction muffler 80. The refrigerant that does not enter suction muffler 80 is able to swirl within the compressor housing (12, 14) into contact with motor 20 and particularly with stator windings 26. The refrigerant fluid will absorb some of the heat from windings 26. At a later time this refrigerant fluid will get suctioned through inlet port 102 and back into cylinder 42.

The refrigerant fluid that enters inlet port 102 is directed by the funnel shape or counter bore of port 102 toward back wall 84 to impact and rebound toward the top opening rim 108 of standpipe 106, which is within line of sight of the portion of the back wall 84 impacted by the refrigerant.

Preferably, inlet port 102 is spaced away from the end of suction tube 55 approximately 0.45 to 0.55 inches with the best performance received at approximately 0.5 inches separating the two. Opening rim 108 of standpipe 106 is sized and dimensioned away from back wall 84 and inlet port 102 to maximize compression performance and provide a maximum flow of refrigerant fluid through standpipe 106. In the preferred form of the invention a distance of 0.55 inches between inlet port 102 and rim 108 has been found to be optimal.

Subcavities 112 created by baffle walls 110 provides superior flow characteristics for refrigerant fluid while reducing transmitted sound. Additionally, by forming baffle walls joining both front, back and top walls 82, 84 and 86 an increase in muffler stiffness is produced enabling muffler 80 to handle greater pressures.

It will be appreciated that the foregoing description of various embodiments of the invention is presented by way of illustration only and not by way of any limitation and that various alternatives and modifications may be made to the illustrated embodiments without departing from the spirit and scope of the invention.

What is claimed is:

1. A compressor comprising:

a housing;

a motor compressor unit disposed within said housing for compressing fluid, said housing having a suction inlet tube emptying refrigerant fluid into the interior of said housing; and a suction muffler comprising:

a rounded plastic box shaped muffler housing having a front wall, a back wall, and side walls connecting therebetween, said front wall having a countersunk inlet port, said suction inlet tube spaced apart from and emptying a first portion of the refrigerant fluid into said inlet port to impact said back wall whereby semi-direct fluid flow into said inlet port is created, said suction inlet tube emptying the remainder of the refrigerant fluid outside of said muffler and into said compressor housing, thereby improving motor cooling;

a suction standpipe having an inlet rim and disposed within said muffler housing extending from said compressor assembly to a location a spaced distance away from said inlet port, said spaced distance dimensioned to provide maximum flow of fluid through said standpipe after fluid from said suction tube impacts said back wall of said muffler housing; and a baffle wall disposed within said muffler housing extending from said front wall to said back wall, said baffle wall located between said standpipe and a said side wall of said muffler housing to form a lateral subcavity that acts as a resonator, said baffle wall located in said muffler housing such that said suction standpipe inlet rim is within line of sight of said back wall impacted by the refrigerant so that said first portion of refrigerant fluid may directly enter said suction standpipe after impacting said back wall.

2. The compressor of claim 1 in which said baffle wall is parallel with said standpipe.

3. The compressor of claim 1 in which two of said side walls are opposite one another, said baffle wall and said standpipe disposed between said opposite side walls.

4. The compressor of claim 1 in which said suction muffler further includes two said baffle walls, said standpipe disposed between said baffle walls.

5. The compressor of claim 1 in which said standpipe is formed integral with said muffler housing.

6. The compressor of claim 1 in which said muffler housing is formed of a two piece construction.

7. The compressor of claim 1 in which two of said side walls are opposite one another, said baffle wall and said standpipe disposed between said opposite side walls, said baffle wall including an end edge and said standpipe including a rim, said end edge and said rim overlapping each other whereby fluid within said subcavity may not enter said standpipe without changing direction.

8. The compressor of claim 1 in which two of said side walls are opposite one another and in which said suction muffler further comprises two said baffle walls to form two subcavities, said standpipe disposed between said baffle walls, said baffle walls disposed between said opposite side walls, said baffle walls including end edges and said standpipe including a rim, said end edges and said rim overlapping each other whereby fluid within said subcavities may not enter said standpipe without changing direction.

9. The compressor of claim 8 in which said subcavities within said muffler housing form a substantially W-shaped volume.

10. The compressor of claim 8 in which said muffler housing is semi-kidney shaped.

11. A suction muffler in combination with a hermetic motor compressor unit disposed within a housing having a suction inlet tube emptying refrigerant fluid into the interior of the housing, said suction muffler comprising:

a rounded thermoplastic box shaped muffler housing having a front wall, a back wall, and side walls connecting therebetween, said front wall having a countersunk inlet port, said suction inlet tube spaced apart from and emptying a first portion of the refrigerant fluid into said inlet port to impact said back wall whereby semi-direct fluid flow into said inlet port is created, said suction inlet tube emptying the remainder of the refrigeration fluid outside of said muffler and into said compressor housing, thereby improving motor cooling;

a suction standpipe having an inlet rim and disposed within said muffler housing extending from said compressor unit to a location a spaced distance away from said inlet port, said spaced distance dimensioned to provide maximum flow of refrigerant fluid through said standpipe after the fluid from said suction tube impacts said back wall of said muffler housing; and a baffle wall disposed within said muffler housing extending from said front wall to said back wall, said baffle wall located both between and parallel with said standpipe and a said side wall to form a lateral subcavity that acts as a resonator, said baffle wall located in said muffler housing such that said suction standpipe inlet rim is within line of sight of said back wall impacted by the refrigerant so that said first portion of refrigerant fluid may directly enter said suction standpipe after impacting said back wall.

12. The suction muffler of claim 11 in which said baffle wall and said standpipe are disposed between opposite side walls.

13. The suction muffler of claim 11 further comprising two said baffle walls, said standpipe disposed between said baffle walls.

14. The suction muffler of claim 11 in which said standpipe is formed integral with said muffler housing.

15. The suction muffler of claim 11 in which said muffler housing is formed of a two piece construction.

16. The suction muffler of claim 11 in which two of said side walls are opposite each other, said baffle wall and said standpipe disposed between said opposite side walls, each said baffle wall including an end edge and said standpipe including a rim, said end edges and said rim overlapping each other whereby fluid within said subcavity may not enter said standpipe without changing direction.

17. The suction muffler of claim 11 further comprising two said baffle walls to form two subcavities, wherein two of said side walls are opposite one another, said standpipe disposed between said baffle walls, said baffle walls and said standpipe disposed between said opposite side walls and each including an end edge and rim respectively, said end edges and said rim overlapping each other whereby fluid within said subcavities formed may not enter said standpipe without changing direction.

18. The suction muffler of claim 17 in which said subcavities within said muffler housing form a substantially W-shaped volume.

19. The suction muffler of claim 17 in which said muffling housing is semi-kidney shaped.

* * * * *